United States Patent [19]

Nickerson

[11] Patent Number: 4,462,195

[45] Date of Patent: Jul. 31, 1984

[54] INSULATING INSERT FOR MASONRY BUILDING BLOCK AND METHOD FOR MAKING SAME

[76] Inventor: David L. Nickerson, 27 Leemond St., Wilbraham, Mass. 01095

[21] Appl. No.: 339,147

[22] Filed: Jan. 13, 1982

[51] Int. Cl.[3] ..... E04B 1/88; E04B 2/08

[52] U.S. Cl. ..... 52/405; 52/309.4

[58] Field of Search ..... 52/405, 309.4, 309.8, 52/309.12, 631

[56] References Cited

U.S. PATENT DOCUMENTS

| | | | |
|---|---|---|---|
| 3,557,840 | 1/1971 | Maybee | 52/631 X |
| 3,649,398 | 3/1972 | Keith | 52/631 X |
| 3,755,031 | 8/1973 | Hoffman et al. | 52/631 X |
| 3,885,363 | 5/1975 | Whittey | 52/405 X |
| 3,903,663 | 9/1975 | Bainter | 52/309.9 X |
| 4,027,445 | 6/1977 | Nickerson | 52/309.12 X |
| 4,193,241 | 3/1980 | Jensen et al. | 52/309.12 X |
| 4,275,539 | 6/1981 | Abbott | 52/405 X |
| 4,380,887 | 4/1983 | Lee | 52/405 |

*Primary Examiner*—J. Karl Bell

*Attorney, Agent, or Firm*—McCormick, Paulding & Huber

[57] ABSTRACT

A molded insulating insert of expanded polystyrene has a central section and hingedly connected side sections which are bendable toward each other to bring the insert to a U-shaped configuration for insertion in a building block cavity. The hinges are formed to provide resistance to full ninety degree bending of the side sections so that the insert side sections are inclined slightly outwardly in a free condition. On flexing inwardly and insertion in a block cavity the side sections tend to spring outwardly and frictionally grip the walls of the cavity. Lug-notch connection means frictionally retain the inserts in the U-shaped configuration and prevent dislodgement of sections in the event of hinge rupture. In molding the inserts, a transfer process is employed with the hinges partially formed in a hot mold and thereafter fully formed in a cold mold. The polystyrene is compressed in the hinge area to a higher density for hinge integrity. Density in the hinge area is approximately doubled. Reflective foil is also applied to the inner surfaces of the side sections.

10 Claims, 6 Drawing Figures

INSULATING INSERT FOR MASONRY BUILDING BLOCK AND METHOD FOR MAKING SAME

BACKGROUND OF THE INVENTION

Preformed insulating inserts of cellular heat insulating material have been employed in masonry building blocks in the past and have been found highly effective in their insulating properties and energy savings. They are generally inserted in the building block cavities at the block plant and are thus highly efficient from a manpower or labor standpoint. They do not interfere with normal procedures in the on site use of the building blocks.

Insulating inserts of the type mentioned are disclosed in U.S. Pat. No. 3,885,363, Richard W. Whittey, INSULATED BLOCK, May 27, 1975 and U.S. Pat. No. 4,027,445, David L. Nickerson, INSULATED BLOCK, June 7, 1977. Reference may be had to these patents for further discussion of insulating properties and other considerations in the manufacture and use of the inserts and masonry blocks insulated therewith.

While generally satisfactory, insulating inserts of the type mentioned above and referred to in the foregoing patents, have been found lacking in certain respects. The cost in dollars and in energy in the manufacture of the inserts has been somewhat higher than desired. Further, and despite the light weight of the inserts, shipping costs have been relatively high due to the substantial bulk of the U-shaped configuration as in the latter patent above.

It is the general object of the present invention to provide an improved insulating insert which can be manufactured and transported in a flat condition and thereafter folded to a U-shaped configuration at the block plant for insertion in the cavity of a building block, the foregoing serving to effect substantial savings in manufacturing cost and in energy.

A further object of the invention resides in the provision of an improved method of molding insulating inserts which results in manufacturing cost and energy savings and which provides a highly effective hinged construction for flat transport and subsequent folding to a U-shaped configuration.

SUMMARY OF THE INVENTION

In fulfillment of the foregoing objects and in accordance with the present invention, a preformed insulating insert of cellular material is provided in a flat generally rectangular form with central and similar but opposite side sections connected by spaced parallel hinge sections. The hinge sections are generally V-shaped in cross section with the hinge adjacent the apex of the V and with the cellular material thereabout of a somewhat higher density than that throughout the remainder of the insert. A hinge of adequate structural integrity is thus provided and the insert is foldable to a generally U-shaped configuration by bending the opposite side sections toward each other along the hinge sections. The side sections are bent through angles somewhat less than ninety degrees with the hinge sections serving to provide a slight resistance to a full ninety degree bending movement of the side sections. Thus, the free folded condition of the insert has the side sections inclined slightly outwardly in the U configuration so as to be further bent toward each other for insertion in the cavity of a masonry building block. Thereafter, the side sections tend to expand to their free condition and frictionally grip the sides of the block cavity for retention therein.

Preferably, the insert is provided at its central section with a finger access notch which is arranged to open at one end of a block cavity adjacent a wall cavity. More specifically, with a conventional building block having a pair of cavities, and with a pair of oppositely oriented U-shaped inserts disposed therein, the notches serve to expose a portion of the center web of the building block. This portion of the web is normally gripped by a mason or mason's helper in handling the block during construction. Thus, conventional construction techniques may be employed with no interference whatever arising from the presence of the insulating inserts.

The insulating inserts also preferably include a retention means for securing the side sections thereof in their inwardly bent condition and with the insert in its U-shaped configuration. In the form shown and described below, the retention means comprises a lug-notch connection with a press fit which results in frictional retention of the lugs in the notches and enhanced structural integrity of the inserts in their U-shaped configuration for handling and insertion in block cavities. Further, upon insertion of the inserts in the block cavities any tendency of one section of an insert to become dislodged from the cavity, as by hinge rupture and relative planar movement of the sections, is effectively prevented by the retention means.

The inserts also preferably include at least one reflective surface such as a reflective foil and, as presently contemplated, each of the side sections of each insert is provided with reflective foil on its inner surface with the insert folded to its U-shaped configuration.

In the method for making the improved preformed inserts of the present invention, a transfer molding process is used instead of the conventional molding process. In the transfer process associated hot and cold molds are employed and the steps of the method include the provision of the hot mold with a thin flat generally rectangular cavity which defines the central and opposite side sections of the insert. In the presently preferred form of the method, the hinge sections of the insert are also partially defined in the hot mold but hinge formation occurs primarily in the cold mold. The cold mold also has a thin flat generally rectangular cavity which defines the central and opposite side sections of the insert and which also defines the spaced parallel hinged sections residing respectively between the central and side sections. The hinge sections are of reduced thickness viewed end-wise and the corresponding cold mold forming parts serve to compress these sections. That is, an insert is molded in the hot mold and is transferred to the cold mold while remaining in a moldable condition. Further molding, or compression of the inserts at the hinge sections occurs in the cold mold and the cellular material of the insert is thus provided with an increased density at the hinge sections whereby to provide integral hinges of the necessary strength and structural integrity. At the present time, a density at the hinge area is employed which is approximately double the density of the insert throughout its remaining portions.

It may be possible to form the hinges exclusively in the cold molds with no preforming whatever in the hot mold but the present partial preforming in the hot mold is found to provide a hinge of high quality.

The transfer molding process not only results in substantial cost and energy savings but is believed to be the only effective way of providing a hinge of the necessary strength and structural integrity.

PREFERRED EMBODIMENTS OF THE PRESENT INVENTION

Directional and geometrical terms such as "top", "bottom", "downwardly", "horizontal", "vertical", etc. are used freely hereinbelow but it is to be understood that such terminology is employed for convenience of description only and is not to be regarded as in any way limiting the invention in the specification or in the claims which follow.

Figure 1:
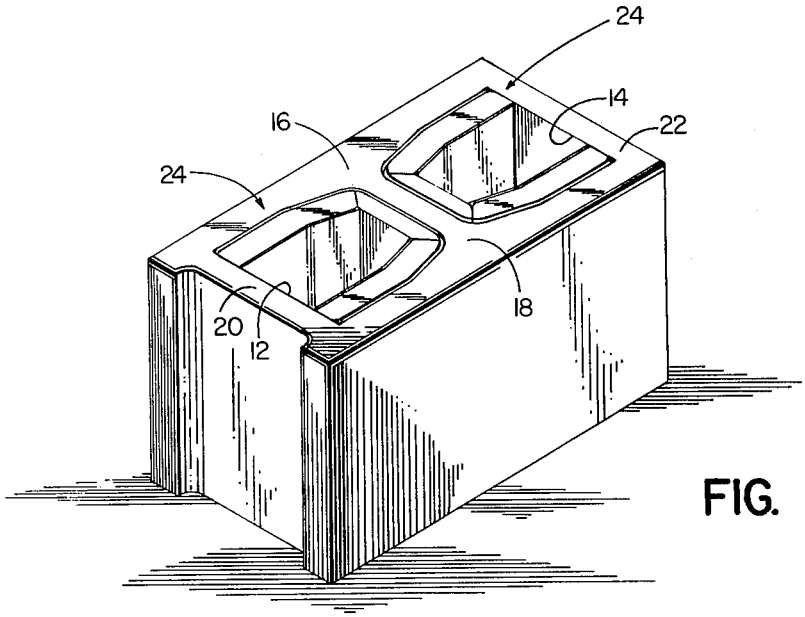
FIG. 1 is a perspective view illustrating a masonry building block having a pair of similar cavities with an insulating insert disposed in each cavity and arranged in opposite or back-to-back relationship adjacent the center web of the block.
Figure 2:
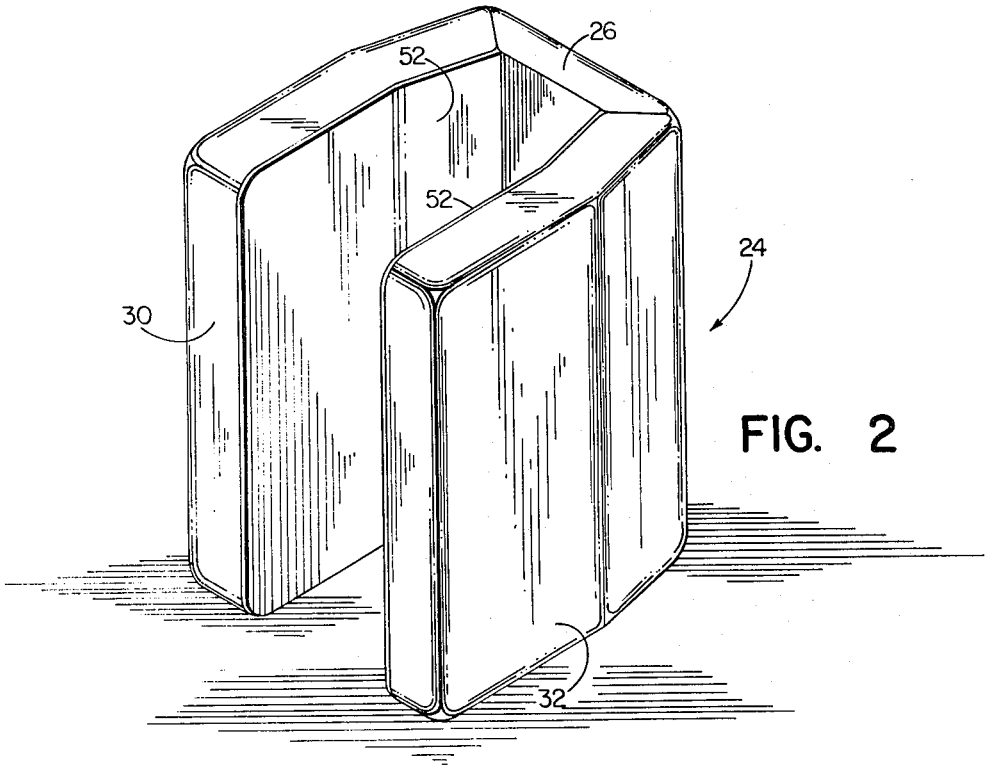
FIG. 2 is a perspective view of a single insulating insert constructed in accordance with the present invention and illustrated in a folded or U-shaped configuration.

Referring particularly to FIGS. 1 and 2, it will be observed that a building block indicated generally at 10 is of a conventional type. The present invention contemplates use of the insulating inserts in masonry building blocks but is in no way limited to blocks of any particular configuration or material.

The building block 10 illustrated is generally rectangular in form with first and second identical cavities 12 and 14 each of which opens through an external surface which may be a top surface 16 of the block and which extends downwardly therefrom a substantial distance and, as shown, throughout the vertical dimension of the block. The building block 10 is preformed as by casting in a conventional manner and has a center web 18 and end walls 20, 22. Conventionally, in handling a block such as the block 10, a mason or his helper grasps the web 18 and manipulates the block as required. Accordingly, finger access notches are preferably provided in the insulating inserts of the present invention.

Figure 3:
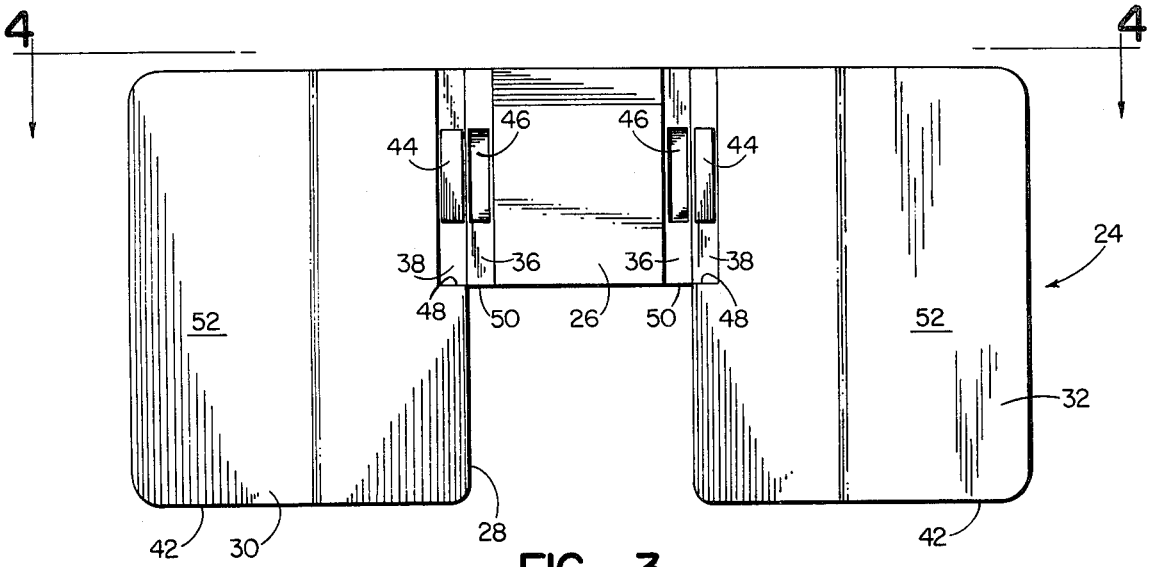
FIG. 3 is a plan view of the insulating insert of FIG. 2 in its flat condition.

Referring particularly to FIG. 3, an insert 24 is shown in flat condition and has a central section 26 provided with a finger access notch 28. In FIGS. 1 and 2 the finger access notches do not appear but are disposed downwardly so as to provide access to the web 18 of the block 10 as required. The building blocks are normally manufactured in the attitude shown in FIG. 1 and it is conventional to insert the insulating inserts 24, 24 with the blocks in the position shown. In use, however, and at the construction site, the blocks are normally reversed in attitude with the finger access to the central web 18 appearing at the top of the block.

Figure 4:
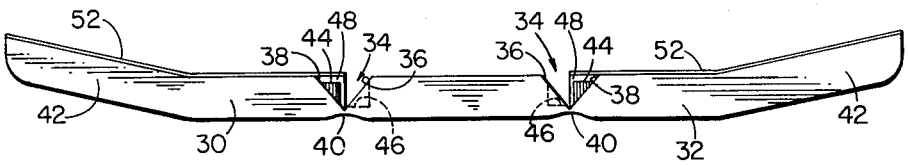
FIG. 4 is an end view taken generally as indicated at 4—4 in FIG. 3 and showing the insulating insert in a flat condition.

The insulating insert of the present invention comprises the central section 26 and similar but opposite side sections 30, 32 formed integrally with the central section and connected thereto by spaced parallel hinged sections 34, 34. The hinge sections 34, 34 are of reduced thickness as best illustrated in FIG. 4 and preferably take a generally V-shape in cross section as shown. That is, in FIG. 4, the upper or inner side of the insert shows relatively large V-shaped recesses defined by the surfaces 36, 38 and relatively small V-shaped recesses are illustrated at the lower or outer surfaces of the insert at 40, 40. The recesses 40, 40 are thought to be optional but may be desirable or even necessary in providing a smoothly rounded outer surface when the insert is folded to its U-shaped configuration as in FIG. 2.

The central section 26 of the insert is substantially flat as shown and the side sections 30, 32 may also be substantially flat. However, as shown, outer portions of the side sections at 42, 42 incline slightly upwardly or inwardly. In the folded configuration such portions tend to provide a close fit in the conventional building block cavities such as the cavities 12, 14 in FIG. 1. The specific configurations of the central and side sections of the insert may of course vary as required.

As will be apparent, the side sections 30, 32 of the insert can be bent toward each other about the hinge sections 34, 34 to the position shown in FIG. 2 whereby to convert the insert to its folded or U-shaped configuration. In accordance with the invention, the V-shaped hinge sections 34, 34 are so constructed or shaped as to prevent the free bending of the side sections 30, 32 through a full ninety degrees. Thus, when the side sections have been bent toward each other to the positions shown in FIG. 2 they remain in a free condition inclined slightly outwardly but flexible inwardly. On insertion of the insert in the block cavity such as the cavities 12, 14, the side sections are slightly flexed inwardly and when the insert is positioned in the cavity the side sections spring outwardly so as to frictionally grip the side walls of the cavity and retain the inserts in the cavities. Such outward flexing also provides for a close fit between the outer surfaces of the inserts and the walls of the cavity, thus enhancing the insulating characteristics of the inserts in the cavities.

The improved insulating insert of the present invention preferably also includes a retention means for securing the side sections thereof in the inwardly bent condition with the insert in its U-shaped configuration as in FIG. 2. Such means may vary in form but as shown comprises a lug-notch connection at each hinge section and the said connection serves not only to retain the insert in its U configuration but also provides an additional feature. That is, in the event of hinge rupture or other dislodgment of the insert parts or sections during insertion in the block cavities, the retention means secures the central and side sections against relative planar movement such as might cause one or more of the sections to become dislodged from the cavity. With the lug-notch connections operative, the sections of the insert are incapable of moving separately relative to each other and bodily movement of the insert must ensue, the latter being precluded by the gripping engagement of the side sections 30, 32 with the cavity walls. Thus, the lug-notch connections may be said to substantially strengthen and lend structural integrity to the hinge sections of the insert.

As best illustrated in FIGS. 3 and 4 small rectangular lugs are formed at 44, 44 on the inclined surfaces 38, 38 and notches 46, 46 in the surfaces 36, 36 respectively receive the lugs. The lugs and notches are so dimensioned as to provide for a press or frictional fit. Thus when engaged on bending or folding of the side sections 30, 32 inwardly, the lug-notch connections serve to restrain the side sections against outward movement. The end walls of the lugs and notches similarly serve to restrain the central and side sections of the insert against relative sliding or planar movement.

A further restraint against relative sliding or planar movement of the central section 26 and the side sections 30, 32 is provided for by inter-engaging shoulders 48, 48 and 50, 50. When the side sections 30, 32 are folded inwardly to the U configuration the shoulders 48, 48 respectively engage the shoulders 50, 50 to restrain the central and side sections against relative movement in at least one direction.

In accordance with another feature of the invention, at least one of the surfaces of the insert 24 is preferably provided with a reflective surface such as a reflective foil for enhancement of its insulating properties. As shown, each of the side sections 30, 32 of the insert is provided with a reflective foil inner surface at 52, 52. The reflective foil may be applied during a molding process, by heat bonding, adhesive means etc.

Hinges of adequate strength and structural integrity are obvious necessities in the manufacture of the improved insulating insert of the present invention. Conventional molding techniques have been found inadequate in this regard with the molded cellular material preferred for insulating purposes. Polystyrene like materials are preferred with expanded polystyrene presently employed at a density of 1.1 to 1.3 pounds per cubic foot. While desirable for insulation properties, such density results in a light weight and fragile material inadequate for good hinge formation in conventional molding processes.

In accordance with the present invention, a relatively new process for molding expanded polystyrenes and the like is employed in making the insulating inserts of the invention. The process, originated in Europe and known as the Ritter process, employs hot and cold molds with the molded parts being transferred from the hot mold to the cold mold for curing. Thus, the process is also referred to in the trade as a "transfer process"; see PLASTICS WORLD, February 1981 issue, page 61 et sequa. Substantial savings in cost and in energy are achieved particularly in the avoidance of the sequential heating and cooling of a heavy mass of metal in a single hot mold. Cycle time is also greatly reduced.

The Ritter or "transfer process" is thus employed in the method of the present invention and novel features and steps are added to provide a high speed and highly efficient molding process and, most importantly, a highly effective and structurally superior hinge construction.

Figure 5:
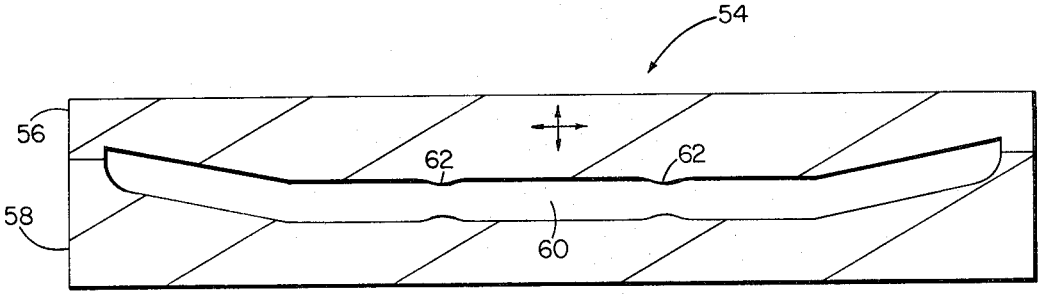
FIG. 5 is a schematic view of a hot mold employed in a transfer process for making the insulating inserts of the present invention.

In accordance with the method of the invention, a hot mold is provided as illustrated schematically in FIG. 5 at 54. Upper and lower mold parts 56, 58 cooperatively define a thin flat and generally rectangular mold cavity 60. The cavity 60 defines the central and side sections of an insulating insert and, as shown, partially defines hinge sections at 62, 62. Alternatively, it is believed that the hinge sections of the insert may be wholly formed in a succeeding step and in a cold mold. Such an alternative procedure will of course simplify and reduce mold cost but is not yet proven in practice.

As is conventional in the Ritter or "transfer process", at least one of the parts of the hot mold is moveable between a hot and cold molding station. As shown, the upper mold part 56 may be regarded as moveable both upwardly and laterally for transfer of an insert or other part from the hot mold to an associated cold mold. The insert or other part remains at an elevated temperature and is capable of further molding on transfer to the cold mold.

The cold mold in a transfer process is normally used for temperature reduction and curing and for retention of the configuration of the part as formed in the hot mold. In accordance with the present invention, further forming or molding is accomplished in the cold mold with the insert or other part being locally compressed to increase density and thus increase the strength and structural integrity of the finished part at the localized area.

Figure 6:
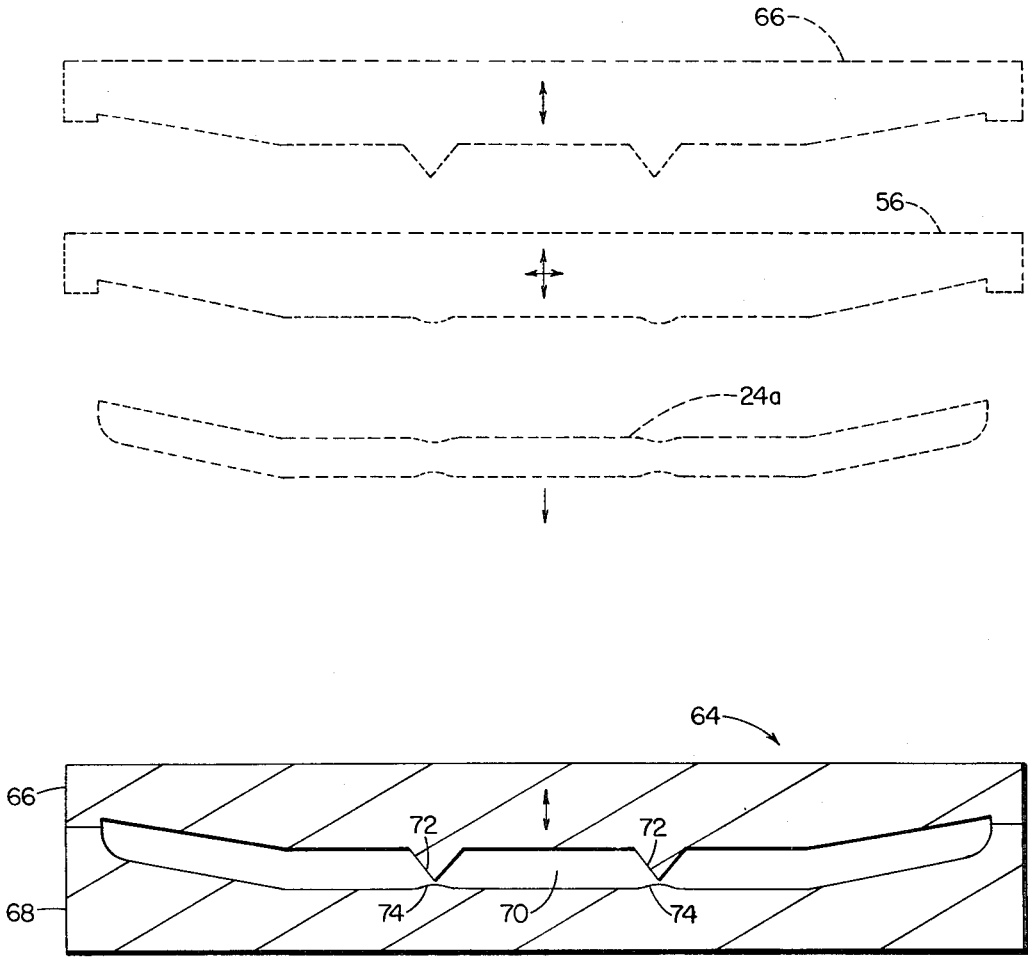
FIG. 6 is a schematic illustration of a cold mold employed in a transfer process for making the insulating inserts of the present invention.

In FIG. 6 a cold mold is indicated generally at 64 and has upper and lower parts shown schematically at 66 and 68 respectively. The mold defines a cavity 70 which takes a thin flat rectangular configuration and which includes mold parts at 72, 72 and 74, 74 for forming the final configuration at the hinge sections of an insulating insert. As will be apparent, the expanded polystyrene or other cellular material at the hinge sections will be compressed by the mold parts 72, 74 resulting in a localized increase in density and the desired increase in strength. At the present time it is believed that density is approximately doubled to a range of approximately 2.2 to 2.6 pounds per cubic foot at the hinge sections of the insulating inserts of the present invention. A highly effective hinge results.

As will be apparent in FIG. 6 the upper part 66 of the cold mold 64 is moveable vertically to a position above the lower part thereof and with sufficient space therebetween for the introduction of the upper part 56 of the hot mold, shown in phantom at 54. With the upper hot mold part 54 disposed as illustrated in phantom line in FIG. 6 an insert 24*a*, partially molded in the hot mold, may be deposited in the lower part 68 of the cold mold 64. Thereafter, the upper part 54 may be returned to the FIG. 5 position for a subsequent hot molding operation and the upper part 66 of the cold mold may be returned from its phantom line position of FIG. 6 to its full line operative position for further molding and curing of the insert.

As stated, the density increase is approximately 100% at the hinge sections in the practice of the method of the present invention. Dimensional changes at the hinge sections in the hot and cold molds are subject to variation and ranges or limits have not been fully established at the present time.

If as mentioned above, it is a practical proceedure to accomplish hinge forming wholly in the cold mold, then, obviously, 100% of all dimensional changes at the hinge sections will occur in the cold mold. The final configuration in one illustrative example of the insulating insert of the present invention, and with an insert approximately $\frac{7}{8}$ of an inch thick, includes a thickness at the apex of the V-shape between 1/32 and 1/16 of an inch. A superior quality hinge results.

In the case where partial forming or molding of the hinge sections occurs in the hot mold, it is believed that no more than one fourth to one half the thickness reduction should occur in the hot mold. This leaves sufficient material for compression and density increase in the cold mold operation. Conversely, it may be said that at least 50% of the thickness reduction should occur in the cold mold and probably at least 75% of the thickness reduction should occur in the cold mold to provide the desired density and strength enhancement.

Again, with an insert $\frac{7}{8}$ of an inch thick, excellent results have been achieved with a thickness of $\frac{1}{4}$ inch to $\frac{1}{2}$ inch at the hinge sections on leaving the hot mold and entering the cold mold and with a final thickness between 1/32 and 1/16 of an inch. Such limits are, however, for illustrative purposes only.

As mentioned, the preferred material is expanded polystyrene but other expandable plastics may be employed as well as other like materials. Similarly, a wide variety of hinge cross sections and other design configurations fall within the scope of the invention.

From the foregoing it will be apparent that a substantially improved insulating insert has been provided. Cost and energy savings in insert production are substantial and yet the insert is highly effective in its intended use. Transportation costs are drastically reduced with the inserts in their flat condition and yet a simple operation results in a folded insert in its U-shaped configuration ready for use.

The method of the invention accomodates high speed, cost and energy efficient production of the inserts and, most importantly, results in an effective hinge having the necessary characteristics of strength and structural integrity. The above-described novel features and steps in the modified Ritter or transfer molding process provide a unique result in the molding of expanded polystyrene and like material. The desired density is retained throughout the major portion of the insulating insert for good heat insulating characteristics and yet the high density localized area at the hinge sections provides for the necessary folding or bending operation in converting the insert to its operative U-shaped configuration.

I claim:

1. A preformed insulating insert for a building block having generally parallel top and bottom surfaces and at least one top-to-bottom through cavity of generally rectangular cross section, the generally rectangular cross sectional configuration and dimensions of said block cavity being subject to variation within a significant range during manufacture; said insert being of light-weight cellular heat insulating material and having a flat condition wherein it is generally rectangular with central and similar but opposite side sections connected to the central section by spaced parallel elongated hinge sections, said hinge sections being generally V-shaped in cross section with the hinge adjacent the apex of the V and with the cellular material thereabout of a substantially higher density than that throughout the remainder of the insert, said last mentioned high density condition prevailing with the insert in its flat condition, and said insert being foldable to a generally U-shaped configuration by bending said opposite side sections toward each other along said hinge sections respectively through angles somewhat less than ninety degrees, said V-shaped hinge sections being so shaped as to provide resistance to a full ninety degrees bending movement of said side sections toward each other, the free folded condition of the insert thus having the side sections inclined slightly outwardly in the U-configuration so as to be further bent toward each other for insertion in said block cavity and thereafter to expand or spring toward their free condition and frictionally grip the sides of the block cavity for retention therein.

2. A preformed insulating insert as set forth in claim 1 wherein a finger access notch is provided in said central section of said insert and is arranged to open at one end of said block cavity adjacent a wall of the cavity.

3. A preformed insulating insert as set forth in claim 1 wherein said insert includes a retention means for securing the side sections thereof in inwardly bent condition with the insert in its U-shaped configuration.

4. A preformed insulating insert as set forth in claim 1 wherein said insert includes means securing said central and side sections of the insert against relative planar sliding movement in a direction which might permit the sections to become dislodged from the block cavity after insertion therein.

5. A preformed insulating insert as set forth in claim 1 wherein a retention means is provided at each of said hinge sections of said insert and takes the form of a lug-notch connection engageable on relative bending of said side sections toward each other.

6. A preformed insulating insert as set forth in claim 5 wherein said lug-notch connections are adapted for frictional engagement for retention of the insert in its U-shaped configuration.

7. A preformed insulating insert as set forth in claim 6 wherein a pair of inter-engageable shoulders are provided at one end of each of said hinge sections for further resistance against relative sliding planar movement of said central and side sections of said insert.

8. A preformed insulating insert as set forth in claim 1 wherein at least one of said opposite side sections is provided on at least one face with a heat reflective surface.

9. A preformed insulating insert as set forth in claim 8 wherein said heat reflective surface is provided on a face of said one side section so as to reside on an inner surface of the side section with the insert in its U-shaped configuration.

10. A preformed insulating insert as set forth in claim 9 wherein heat reflective surfaces are provided on each of said side sections so as to reside on inner surfaces of the side sections with the insert in its U-shaped configuration.

* * * * *